US009255439B2

(12) United States Patent
Goossens et al.

(10) Patent No.: US 9,255,439 B2
(45) Date of Patent: Feb. 9, 2016

(54) VISION LITE AND SCREW BOSS CHANNEL

(71) Applicant: PEMKO MANUFACTURING COMPANY, INC., Ventura, CA (US)

(72) Inventors: Philip Anthony Goossens, Cordova, TN (US); Gary Lawrence Higginbotham, Jr., Olive Branch, MS (US); Jeffrey G. Karl, Portage, MI (US)

(73) Assignee: PEMKO MANUFACTURING COMPANY, INC., Ventura, CA (US)

( * ) Notice: Subject to any disclaimer, the term of this patent is extended or adjusted under 35 U.S.C. 154(b) by 0 days.

(21) Appl. No.: 14/211,003

(22) Filed: Mar. 14, 2014

(65) Prior Publication Data

US 2014/0259525 A1 Sep. 18, 2014

Related U.S. Application Data

(60) Provisional application No. 61/790,492, filed on Mar. 15, 2013.

(51) Int. Cl.

| | |
|---|---|
| ***E04B 1/00*** | (2006.01) |
| ***E06B 3/58*** | (2006.01) |
| *E06B 3/54* | (2006.01) |

(52) U.S. Cl.

CPC ..... *E06B 3/5892* (2013.01); *E06B 3/549* (2013.01); *Y10T 16/78* (2015.01)

(58) Field of Classification Search

CPC ..... E06B 1/60; E06B 1/12; E06B 1/18; E06B 1/34; E06B 1/36; E06B 1/52; E06B 1/6007; E06B 1/6046; E06B 3/5892; E06B 3/60; E04F 19/06

USPC ..... 52/784.1, 60, 79.9, 79.12, 213, 208, 52/204.53, 204.54, 204.67, 205.68, 52/204.71, 204.72, 464, 468

See application file for complete search history.

(56) References Cited

U.S. PATENT DOCUMENTS

| | | | | |
|---|---|---|---|---|
| 2,200,227 | A | 5/1940 | Olson | |
| 3,099,335 | A | 7/1963 | Sklar | |
| 3,475,870 | A | 11/1969 | Birum, Jr. | |
| 3,564,666 | A * | 2/1971 | Dold | 24/320 |
| 3,680,620 | A | 8/1972 | Gotschel | |
| 4,259,818 | A * | 4/1981 | Stark | 52/208 |

(Continued)

FOREIGN PATENT DOCUMENTS

| | | |
|---|---|---|
| CH | 583 400 | 12/1976 |
| DE | 1101865 | 3/1961 |
| EP | 0118322 | 9/1984 |

*Primary Examiner* — Patrick Maestri

(74) *Attorney, Agent, or Firm* — Michael G. Johnston; Moore & Van Allen PLLC

(57) ABSTRACT

A kit for mounting a frame in a partitioning structure such as a door, and a door including a vision lite. The kit includes a male frame half, a female frame half, and threaded fasteners. The female frame half defines an elongated channel, where the channel includes a bottom with walls extending therefrom with a width adapted to receive a threaded fastener. The first frame piece and the second frame piece are configured to be mounted to each other when the threaded fasteners extend through the first frame piece and into the channel. An installation of such a kit in a door, with window glass, may provide a vision lite in the door. The channel may be configured such that the threaded fasteners penetrate the bottom of the channel when the first frame piece and the second frame piece are installed. The threaded fasteners may be self-tapping screws.

25 Claims, 6 Drawing Sheets

(56) References Cited

U.S. PATENT DOCUMENTS

| | | | | |
|---|---|---|---|---|
| 4,599,484 | A | 7/1986 | Bramwell | |
| 4,708,554 | A | 11/1987 | Howard | |
| 5,042,220 | A | 8/1991 | Jackson | |
| 5,352,002 | A | 10/1994 | Vouillon | |
| 5,636,484 | A | 6/1997 | De Block | |
| 5,970,675 | A | 10/1999 | Schray | |
| 6,318,037 | B1 | 11/2001 | Hansen | |
| 6,546,682 | B1 | 4/2003 | DeBlock | |
| 6,698,154 | B2 * | 3/2004 | Vance | 52/716.6 |
| 7,229,239 | B2 | 6/2007 | Koessler | |
| 7,748,924 | B2 | 7/2010 | Woxman | |
| 7,976,257 | B2 | 7/2011 | Kufner | |
| 8,359,796 | B1 | 1/2013 | Plummer | |
| 8,567,145 | B1 | 10/2013 | Chauncey | |
| 2003/0000163 | A1 | 1/2003 | Lamanna | |
| 2003/0024182 | A1 * | 2/2003 | Yeany | 52/204.67 |
| 2007/0193140 | A1 | 8/2007 | Carnick | |
| 2011/0239560 | A1 | 10/2011 | Landeros | |

* cited by examiner

VISION LITE AND SCREW BOSS CHANNEL

CROSS-REFERENCE TO RELATED APPLICATION

This application claims the benefit of U.S. Patent Application No. 61/790,492, entitled "Screw Boss Channel and Door Lite Kit," filed Mar. 15, 2013, the entire contents of which are incorporated herein by reference.

FIELD

Aspects of the disclosure generally relate to a framed opening in a partitioning structure such as a door or wall, and in particular may relate to a door lite kit for providing a vision lite that includes means for allowing variable positioning of fasteners for mounting the kit.

BACKGROUND

A vision lite may provide a glass window through a door. In some cases, vision lites may be provided with aftermarket lite kits, and do not require drilling through the door for installation. Vision lites in some cases are metal and may use fire rated glass to make a fire rated window in a fire rated door. Conventional lite kites include a two piece frame that is fastened together with screws. An inner piece or half and an outer piece or half of the frame each overlaps the door on a respective side and is contoured to form, with the other piece, a slot for receiving the glass. Glazing compound is applied between the frame and the glass.

Generally, the outdoor frame piece is a blank that has predrilled screw holes in a hidden inner portion that attempt to match locations of predrilled screw holes in the inner frame piece. Installation may be challenging because the screw hole positions must be substantially aligned to allow installation of the screws, and the installer has to direct the screws into holes that cannot be seen and that may be spaced from the entrance holes in the outer piece by half of the door width or more. Specifically, when the frames are each in place on the respective sides of the door, screws are installed through holes in the exposed portion of the inner frame. The screws must then extend to the predrilled holes in the inner end of the inner frame piece, proximate to the glass, and then through the holes in the inner end of the outer frame piece or through the frame, also proximate to the glass. The need to thread the screws through the predrilled holes may make the process time consuming and difficult, as an installer blindly feels for the holes in the inner ends of the frame pieces, which difficulty may be compounded by the inner and outer frame pieces possibly being out of alignment to some degree.

SUMMARY

In accordance with one embodiment of the concepts disclosed herein, a kit for mounting a frame in a partitioning structure is provided. The kit includes a first frame piece forming a perimeter defining a first opening, a second frame piece forming a perimeter defining a second opening, and threaded fasteners. The second frame piece defines an elongated channel, where the channel includes a bottom with walls extending therefrom with a width adapted to receive a threaded fastener. The first frame piece and the second frame piece are configured to be mounted to each other when the threaded fasteners extend through the first frame piece and into the channel.

In accordance with another embodiment of the concepts disclosed herein, a door including a vision lite is provided, including a door having two sides and defining a window opening therethrough and a frame in the window opening. The frame includes a first frame piece defining holes for threaded fasteners spaced along the first frame piece, where the first frame piece forms a perimeter defining a first opening. A second frame piece forms a perimeter defining a second opening, where the second frame piece defines an elongated channel. The channel includes a bottom with walls extending therefrom with a width adapted to receive a threaded fastener. Threaded fasteners are included. The first frame piece and the second frame piece are mounted to each other from each side of the door with the threaded fasteners and the frame is mounted to the door. The threaded fasteners extend through the first frame piece and into the channel.

In some embodiments and in combination with the above embodiments, the channel is configured such that the threaded fasteners penetrate the bottom of the channel when the first frame piece and the second frame piece are mounted to each other. In some such embodiments, the threaded fasteners are self-tapping screws.

In some embodiments and in combination with the above embodiments, the channel is configured such that when the threaded fasteners are inserted into the channel, the walls spread and apply lateral force to the threaded fastener. In some embodiments and in combination with the above embodiments, the first frame piece and the second frame piece each comprise metal sheet. In some embodiments and in combination with the above embodiments, the first frame piece and the second frame piece comprise roll formed steel. In some embodiments and in combination with the above embodiments, the first frame piece and the second frame piece each comprise four elongated members assembled into a rectangular shape.

In some embodiments and in combination with the above embodiments, the second frame piece comprises a web with first and second legs extending therefrom in the same direction and in parallel alignment to respective distal ends. The first leg is configured to abut a face of the door and a flange extending from the second leg distal end in a direction away from the first leg. The channel is on one side of the flange and is configured with its closed end in the direction of the first leg. In some embodiments and in combination with the above embodiments, the second frame piece is of one-piece, seamless, unitary construction.

In some embodiments and in combination with any of the above embodiments, a window is secured in the window opening between portions of the first frame piece and the second frame piece.

In some embodiments and in combination with the above embodiment, the channel is configured such that the threaded fasteners penetrate the bottom of the channel when the first frame piece and the second frame piece are mounted to each other. In some such embodiments, the threaded fasteners are self-tapping screws.

In some embodiments and in combination with the above embodiments, the channel is configured such that when the threaded fasteners are inserted into the channel, the walls spread and apply lateral force to the threaded fastener. In some embodiments and in combination with the above embodiments, the first frame piece and the second frame piece each comprise metal sheet. In some embodiments and in combination with the above embodiments, the first frame piece and the second frame piece comprise roll formed steel. In some embodiments and in combination with the above embodiments, the first frame piece and the second frame piece each comprise four elongated members assembled into a rectangular shape.

In some embodiments and in combination with the above embodiments, the second frame piece comprises a web with first and second legs extending therefrom in the same direction and in parallel alignment to respective distal ends. The first leg is configured to abut a face of the door and a flange extending from the second leg distal end in a direction away from the first leg. The channel is on one side of the flange and is configured with its closed end in the direction of the first leg. In some embodiments and in combination with the above embodiments, the second frame piece is of one-piece, seamless, unitary construction.

In accordance with another embodiment of the concepts disclosed herein, a partitioning structure including a framed opening is provided. A partitioning structure has two sides and defines an opening therethrough, with a frame disposed in the structure opening. The frame includes a first frame piece defining holes for threaded fasteners spaced along the first frame piece. The first frame piece forms a perimeter defining a first opening. A second frame piece forms a perimeter defining a second opening, with the second frame piece defining an elongated channel. The channel includes a bottom with walls extending therefrom with a width adapted to receive a threaded fastener; threaded fasteners are provided. The first frame piece and the second frame piece are mounted to each other from each side of the partitioning structure with the threaded fasteners and the frame is mounted to the partitioning structure, where the threaded fasteners extend through the first frame piece and into the channel. In some such embodiments the partitioning structure is a door, and in other such embodiments the partitioning structure is a wall.

In accordance with another embodiment of the concepts disclosed herein, a method of assembling a door lite kit in a door is provided. The door has two sides and defines a window opening therethrough, and the door lite kit includes a first frame piece, a second frame piece, widow glass, and threaded fasteners. The first frame piece defines holes for threaded fasteners spaced along the first frame piece, where the first frame piece forms a perimeter defining a first opening. A second frame piece forms a perimeter defining a second opening, where the second frame piece defines an elongated channel. The channel includes a bottom with walls extending therefrom with a width adapted to receive a threaded fastener. The method includes disposing the first frame piece and the second frame piece around the window opening, and extending threaded fasteners through the first frame piece and into the channel. The first frame piece is mounted to the second frame piece and the frame is mounted to the door. In some embodiments and in combination with the above embodiment, the method includes causing the threaded fasteners to penetrate the bottom of the channel to secure the first frame piece to the second frame piece.

BRIEF DESCRIPTION OF THE DRAWINGS

For a more complete understanding, reference should now be had to the embodiments shown in the accompanying drawings and described below. In the drawings.

DETAILED DESCRIPTION

The following detailed description of embodiments refers to the accompanying drawings, which illustrate specific embodiments. Other embodiments having different structures and operation do not depart from the scope of the present disclosure.

Embodiments of concepts disclosed herein are directed to a vision lite that may be a door lite kit for installing a frame in an existing or new door, or a wall, with or without a window. A screw-receiving feature may be provided as part of the vision lite. One frame piece of the vision lite may have a U-shaped channel attached to it, with the channel configured to receive screws that extend though the predrilled holes of the exposed portion of the other frame piece.

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures or the orientation of a part in the installed position. Indeed, the referenced components may be oriented in any direction and the terminology, therefore, should be understood as encompassing such variations unless specified otherwise. Throughout this disclosure, where a process or method is shown or described, the method may be performed in any order or simultaneously, unless it is clear from the context that the method depends on certain actions being performed first.

Figure 1:
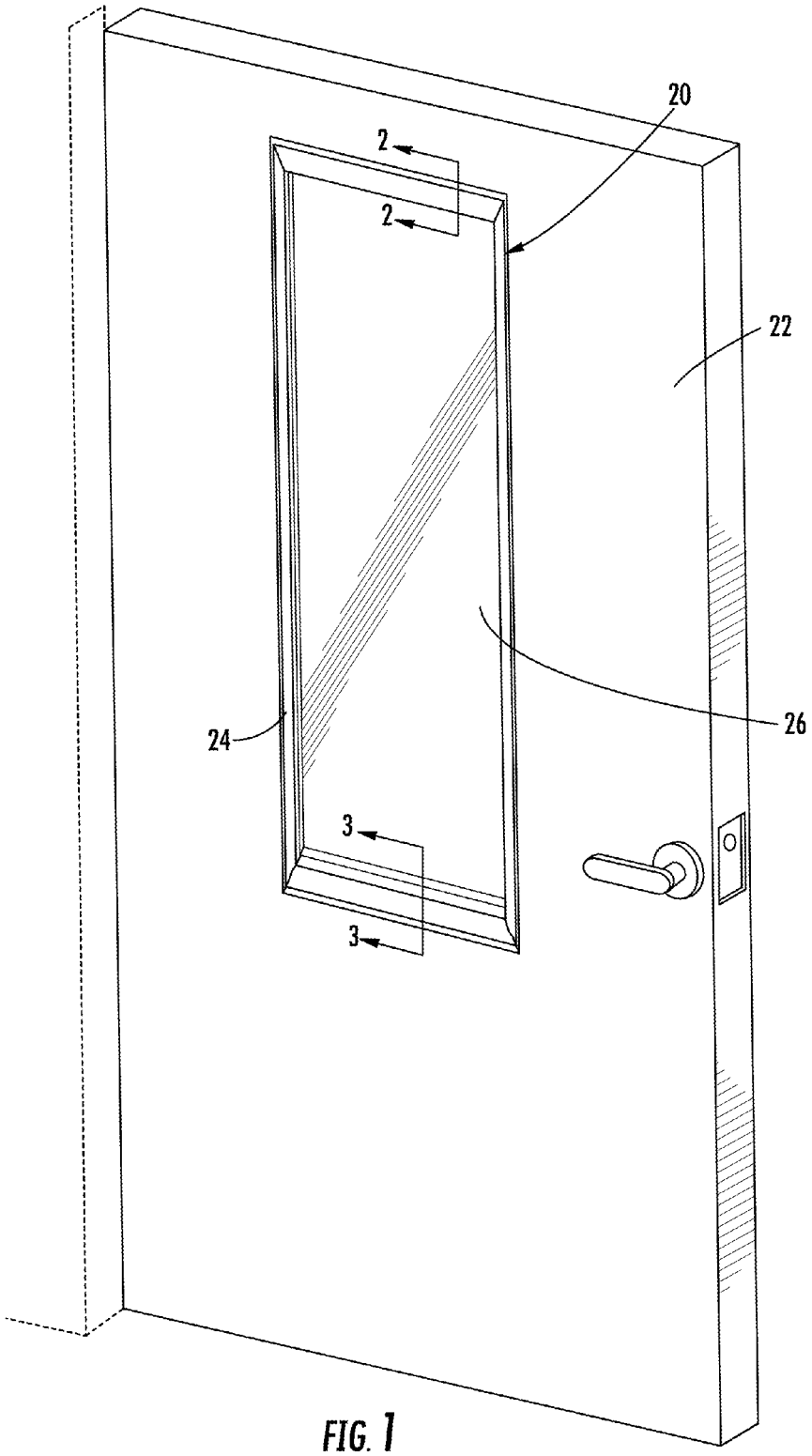
FIG. 1 is a perspective view of a door including an embodiment of a lite kit disclosed herein.
Figure 2:
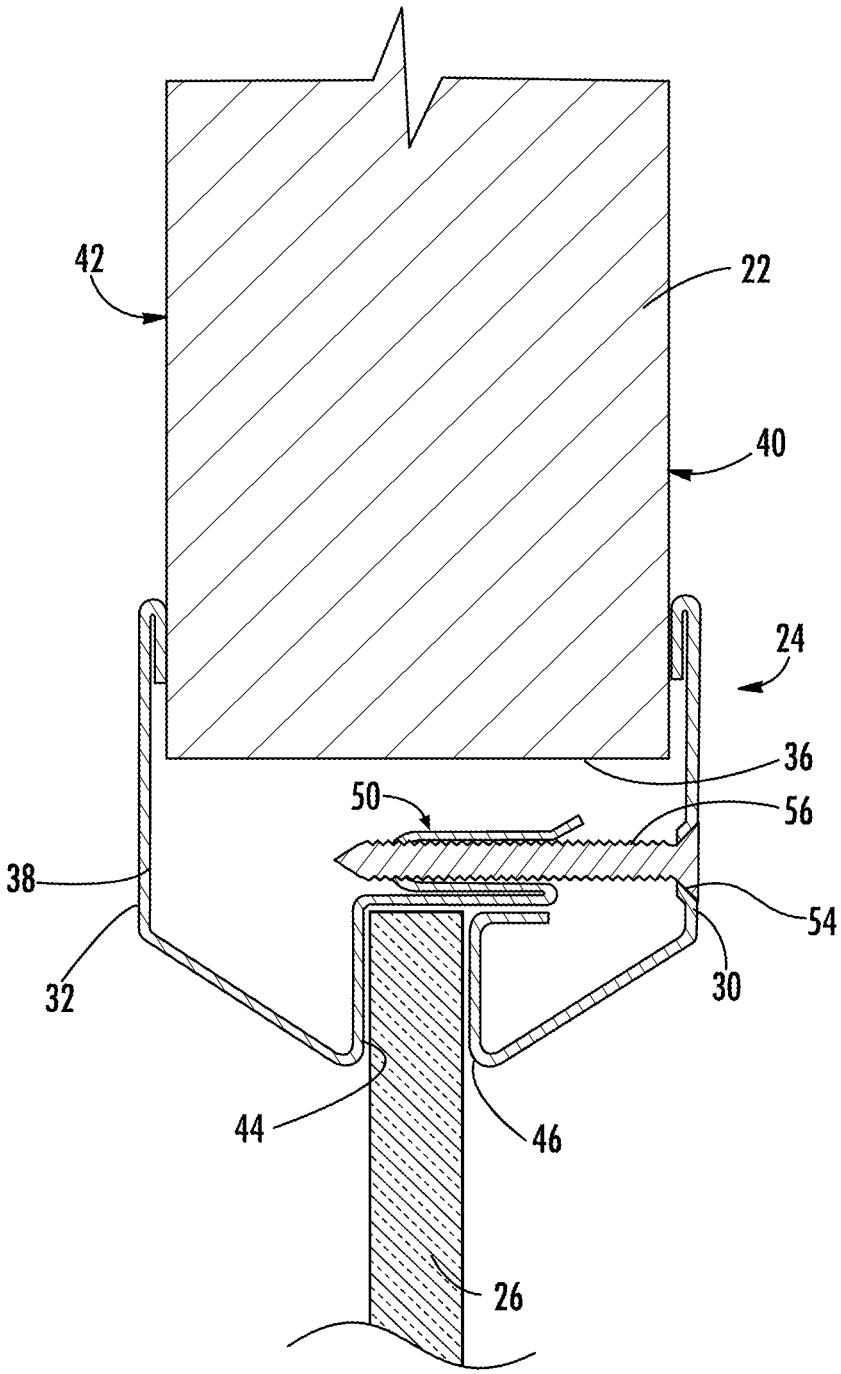
FIG. 2 is a section view of the installed door lite kit of FIG. 1 taken along line 2-2 of FIG. 1.
Figure 3:
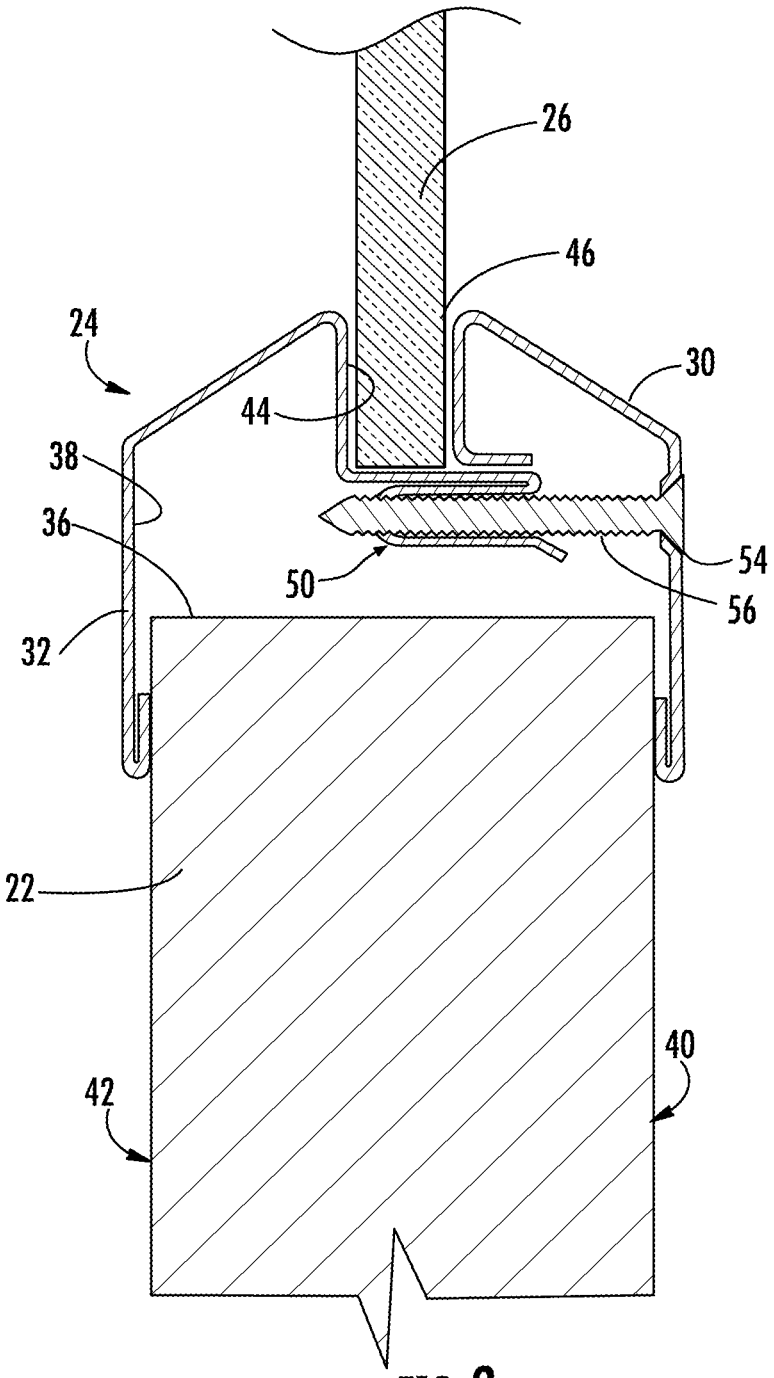
FIG. 3 is a section view of the installed door lite kit of FIG. 1 taken along line 3-3 of FIG. 1.

Referring to the drawings, where like reference numerals refer to the same or similar parts, FIG. 1 shows an apparatus that may be referred to as a door lite lit 20. The door light kit 20 is mounted to the door 22 in an opening in the door 22, and includes a frame 24 and a window 26, which may be for example, clear or opaque glass or other material. The door 22 may alternatively be a wall or other partitioning structure. A "partitioning structure" may be a door, a wall, or other structure, movable or stationary, that can separate interior rooms or separate an interior room and the exterior of a building. FIGS. 2 and 3 show section views at top and bottom of the lite kit 20; section views of the left and right side may be expected to be substantially similar.

FIGS. 2 and 3 each show a male frame half 30, or first frame piece, and female frame half 32, or second frame piece, mounted to male frame half 30. The frame halves 30, 32 are aligned around the opening 36 in the door 22 (or the door 22 could depict a wall or other partitioning structure) to receive the door in the elongated opening 38 formed by the frame halves 30, 32. As shown, the door 22 may be spaced from the frame halves 30, 32 within the opening 38 proximate to the door 22. The inside surfaces of the frame halves 30, 32 at their tops (in FIG. 2) or their bottoms (in FIG. 3) abut the inside surface 40 and outside surface 42 of the door 22 tightly. Across the opening 38 in the frames 30, 32 from the door 22 is the window 26. The window 26 is also received in an elongated opening 44 formed by the frame halves 30, 32.

Glazing is typically placed in the glazing pocket 46 formed in this opening 44 between the glass and the frame halves 30, 32 to secure and seal the glass in position. The opposing forces applied by the male frame half 30 and the female frame half 32 press against and trap the frame 24 to mount it to the door 22 tightly, and press against and trap the window 26 to mount the window 26 to the frame 24 and indirectly to the door 22.

A screw-receiving feature such as a screw boss channel 50 may be provided along the edge of the inner portion of one of the frame halves 32, making this the female frame half 32, as it will receive a screw 56. The screw boss channel 50 may be, for example, a substantially U-shaped channel, as shown. The screw boss channel 50 may be dimensioned to accept a predetermined screw size into the channel 50. The other frame half 30 may have predrilled holes 54 for fasteners, which may be threaded fasteners such as screws 56, and the screws 56 extend though the male frame piece 30. Although the threaded fasteners are referred to as screws herein, it should be understood that other threaded fasteners may be used as known to one of ordinary skill in the art. The screws 56 may be self-tapping, and may penetrate the bottom of the channel 50, puncturing a hole to extend through the channel 50 to secure the screw 56 to the female frame half 32. When the channel 50 receives the screw, the walls of the channel 50 may also be spread slightly and thereby with resilient material strength apply a force to the screw 56 to grip and secure the screw 56 in position.

The channel 50 may run along the internal perimeter of the frame 24. In the case of a rectangular frame, the screws 56 may be inserted anywhere along a horizontal channel, with the location of the screw 56 horizontally being substantially inconsequential, because instead of needing to be inserted in a hole as in conventional frames, the screw 56 can be inserted along a line, and the precise location of the screw in the horizontal direction is not critical because of the helpful configuration of the opening to the channel 50. Likewise, the screws 56 may be inserted anywhere along a vertical channel, with the location of the screw 56 vertically being substantially inconsequential, because instead of needing to be inserted in a hole, the screw can be inserted along a line, and again the precise location of the screw in the vertical direction is not critical because of the helpful configuration of the opening to the channel 50. In effect, the location of the screws 56 may vary in one direction, in the embodiment shown either in the horizontal or vertical position as applicable depending on the orientation of the channel 50.

Because the heads of the screws 56 may be accessible from the outside of the male frame half 30, and no screws 56 are accessible from the outside of the female frame half 32, the female frame half 32 may be generally expected to be placed on the side of the door 22 from which access to intended to be denied 42 when the door is locked, for example, the outside of a building or of a room. The male frame half 30 is often used on inside side 40 of the door 22, on the inside of the building or room, preventing someone who is trying to break in from accessing the screws 56.

Figure 4:
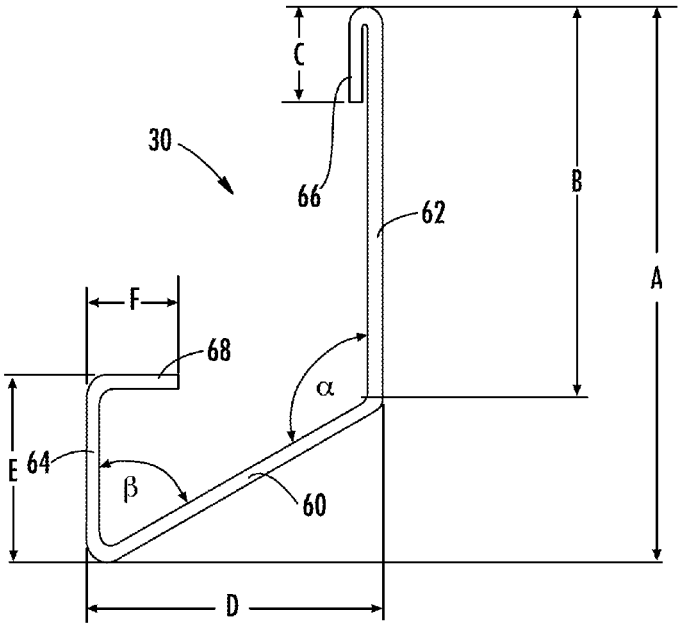
FIG. 4 is an end view of an embodiment of a male half of a frame of the door lite kit of FIG. 1.
Figure 5:
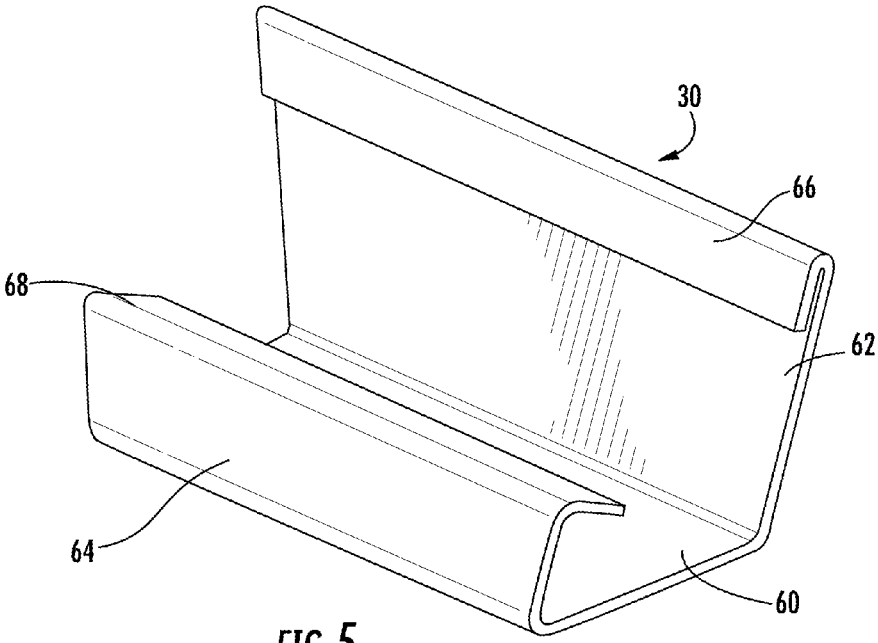
FIG. 5 is a perspective view of the male half of the frame of FIG. 4.

FIGS. 4 and 5 show an embodiment of the male frame half 30. The male frame half 30 may include a web 60 with two legs 62, 64 extending from it. When installed, the longer leg 62 may be positioned on the inside surface of the door 22. Referring to the orientation in FIG. 4, the upper or distal end of the longer leg 62 includes a return 66, which strengthens the end and provides a rounded edge. The web 60 is at an angle $\alpha$ relative to the longer leg 62. Angle $\alpha$ is shown herein to be 120 degrees, but it could be other angles, as may be preferred for the design; for example, if it were desired for the web 60 to have a horizontal surface when installed, angle $\alpha$ would be 90 degrees. The shorter leg 64 may form an angle $\beta$ relative to the web supplementary to angle $\alpha$, in the embodiment shown being 60 degrees. This makes both the longer leg 62 and the shorter leg 64 vertical when installed (if considered when in the locations of the sections of FIGS. 2 and 3). A flange 68 may extend at a right angle from the upper or distal end of the shorter leg 64 in the direction back toward the web 60 and longer leg 64.

In a configuration like the embodiment of FIGS. 4 and 5, approximate dimensions of an embodiment of the male frame half 30 may be on the order of the following: overall height A: 1.5"; length of longer leg 62 B: 1.0"; length of return 66 C: 0.25"; spacing between shorter leg 64 and longer leg 62 D: 0.8"; length of shorter leg 64 (outside dimension) E: slightly more than 0.5"; length of flange 68 F: 0.25".

Figure 6:
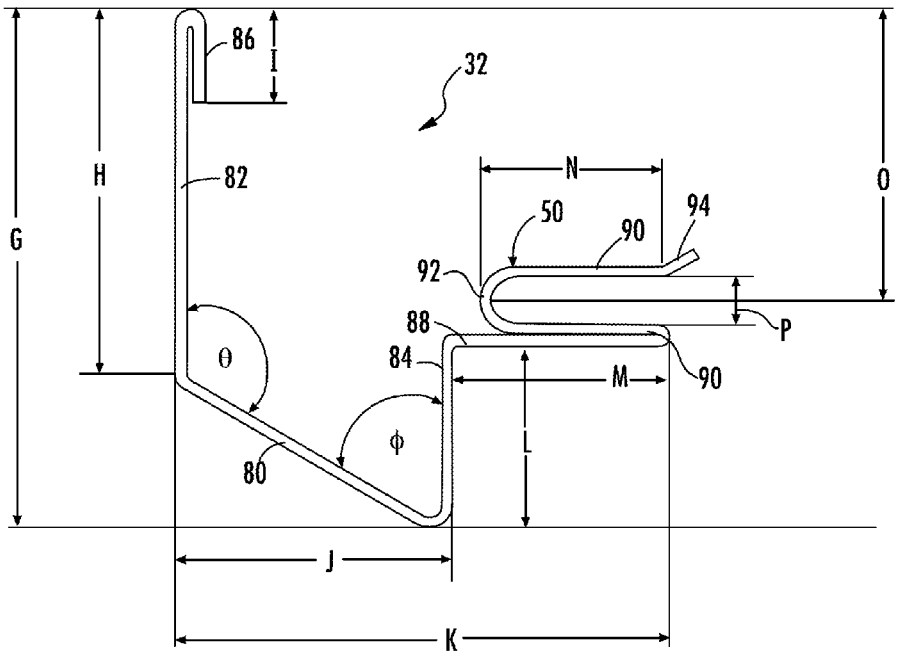
FIG. 6 is an end view of an embodiment if a female half of a frame of the door lite kit of FIG. 4.
Figure 7:
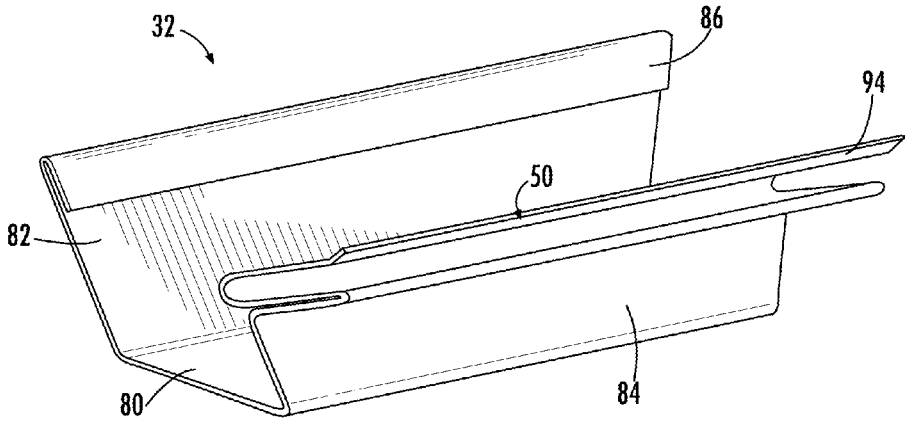
FIG. 7 is a perspective view of the female half of the frame of FIG. 4.

FIGS. 6 and 7 show an embodiment of the female frame half 32. The female frame half 30 may include a web 80 with two legs 82, 84 extending from it. When installed, the longer leg 82 may be positioned on the outside surface of the door 22. Referring to the orientation in FIG. 6, like the male frame half 30, the upper or distal end of the longer leg 82 of the female frame half 32 includes a return 86, which strengthens the end and provides a rounded edge. The web 80 is at an angle $\theta$ relative to the longer leg 82. Angle $\theta$ is shown herein to be 120 degrees and be the same as angle $\alpha$ of the male frame half 30, but it could be other angles, as may be preferred for the design; for example, if it were desired for the web 80 to have a horizontal surface when installed, angle $\theta$ would be 90 degrees. The shorter leg 84 may form an angle $\phi$ relative to the web supplementary to angle $\theta$, in the embodiment shown being 60 degrees. This makes both the longer leg 82 and the shorter leg 84 vertical when installed (if considered when in the locations of the sections of FIGS. 2 and 3).

A flange 88 may extend at a right angle from the upper or distal end of the shorter leg 84 in the direction away from the web 80 and longer leg 84. Extending from the flange 88 is the channel 50. The channel 50 includes sides 90 and a bottom 92. One of the sides 90 is a return on the flange 88, providing strength and support, and as may readily be formed with roll forming of metal. The entrance to the channel 50 may by flared 94, being made wider to relatively easily accept the screws 56.

In a configuration like the embodiment of FIGS. 6 and 7, approximate dimensions of an embodiment of the male frame half 30 may be on the order of the following: overall height G: 1.5"; length of longer leg 62 H: 1.0"; length of return 66 I: 0.25"; spacing between shorter leg 64 and longer leg 62 J: 0.8"; length of shorter leg 64 L (inside dimension): slightly less than 0.5"; length of flange 68 M: 0.6"; depth of channel (outside dimension) N: 0.5"; distance from top of longer leg 82 to centerline of channel 50 O: 0.8"; width of channel 50 P: 0.13. As shown, dimensions G=A, H=B, I=C, and J=D to provide a frame 24 that has the same appearance on both sides of the door 22, but this is not required.

The frame halves 30, 32, including the channel 50, may be fabricated in a variety of ways and from various materials. However, one possible material is roll formed steel, such as cold rolled steel components rolled from metal sheet; other metal or other materials, such as extruded aluminum, or other methods of manufacture, such as extrusion or casting, may be as selected by one of ordinary skill in the art. However, roll formed metal may be desirable as it may allow the forming of the profile of each frame half 30, 32 from one piece of material, meaning one piece, seamless, unitary construction (without needing to assemble pieces to put together the shape shown in FIGS. 6 and 7), that may be relatively thin, economical, and with beneficial mechanical properties. In one embodiment, the material for the frame halves may be galvanneal steel alloy sheet conforming to ASTM A653, coating weight A40, 20 gauge (0.0359-0.0396 inch thick) for the male frame half 30, 22 gauge (0.0299-0.0366 inch thick) for the female frame half 32.

Figure 8:
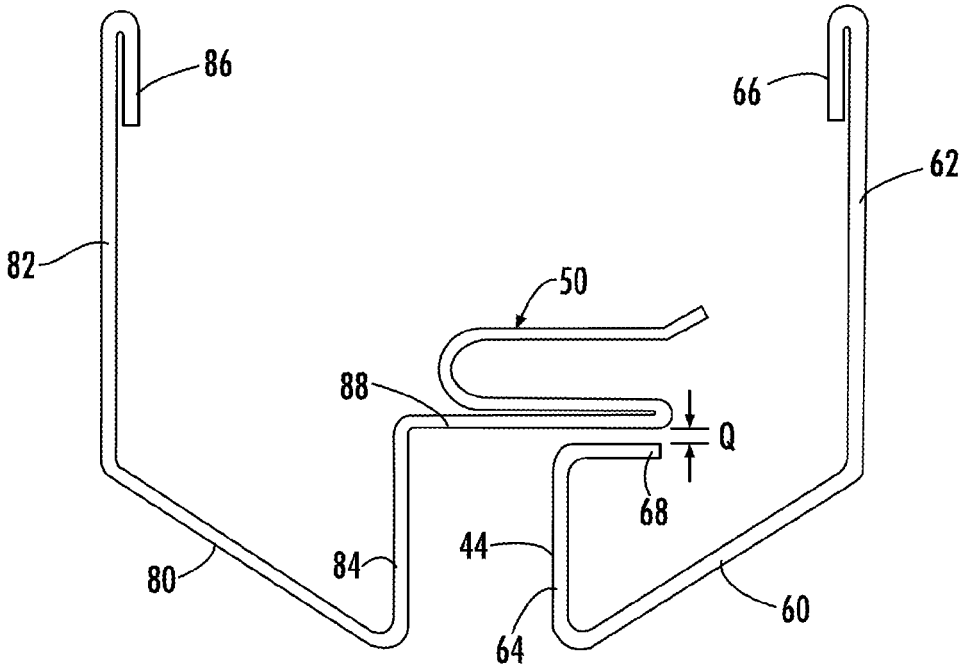
FIG. 8 is a detail view of the frame halves of FIGS. 4-7, configured as installed.

The detail view of FIG. 8 shows the male frame half 30 and the female frame half in their configuration for application to a door 22. A standard door thickness is 1¾ inches and glass thickness may be ⅜ inch; the embodiments of frame halves 30, 32 described above in FIGS. 4 and 6 are dimensioned to accommodate these standard thicknesses, although the dimensions may be changed. In the embodiment of FIG. 8, the channel 50 is shown to extend across the top of the glass opening 44, such that the opening of the channel 50 is proximate to the longer leg 62 of the male frame half 30. Predrilled holes for the fasteners/screws 56 in the male frame half 30 (see FIGS. 2 and 3) should be positioned with their centerlines close to the dimension O indicated on FIG. 6 for the centerline of the channel 50 from the top of the longer leg of the female frame half 32. This may help place the predrilled holes in approximate alignment with the channel 50. FIG. 8 also shows that the top of the flange 88 of the female frame half 32 is spaced from the bottom of the flange 68 of the male frame half 30 by the distance Q. In the embodiment shown, Q may be approximately 0.03 inches. This spacing provides for adjustment and positioning of the flange 88 of the female frame half 30 within the flange 68 of the male frame half 30, and potentially for deflection of the channel 50 if necessary when the screws 56 are inserted.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein. While the foregoing is directed to embodiments of a vision lite and door lite kit, and discloses that the same or similar embodiments may be applied to other partitioning structures, such as walls, other and further embodiments may be devised without departing from the basic scope thereof, and the scope thereof is determined by the claims that follow.

What is claimed is:

1. A door including a vision lite, the door comprising:

a door having two sides and defining a window opening therethrough; and a frame in the window opening, the frame comprising a first frame piece defining holes for threaded fasteners spaced along the first frame piece, the first frame piece forming a perimeter defining a first opening, a second frame piece forming a perimeter defining a second opening, the second frame piece comprising a web having a first end and a second end with a first leg extending in a first direction from the first end of the web to a first distal end and a second leg extending in the first direction from the second end of the web to a second distal end to place the first leg and the second leg in parallel alignment, the first distal end of the first leg having an end configured to abut a face of the door, a flange extending from the second distal end of the second leg in a direction away from the first leg, and walls extending from the flange and defining an elongated channel, the channel disposed on one side of the flange and having an open end and a closed end, the channel walls configured such that the closed end of the channel is between the open end of the channel and the first leg, the channel walls defining a width configured to receive a threaded fastener, and threaded fasteners, wherein the first frame piece and the second frame piece are secured to each other from each side of the door with the threaded fasteners for mounting the frame to the door, wherein the threaded fasteners extend through the holes in first frame piece and into the channel, without the first frame piece penetrating the opening between the walls of the channel.

2. The door of claim 1, wherein the second frame piece is of one-piece, seamless, unitary construction.

3. The door of claim 1, wherein the elongated channel is continuous around the second frame piece.

4. The door of claim 1, further comprising a window secured in the window opening between portions of the first frame piece and the second frame piece.

5. The door of claim 1, wherein the channel is configured such that the threaded fasteners penetrate the bottom of the channel when the first frame piece and the second frame piece are secured to each other.

6. The door of claim 1, wherein the threaded fasteners are self-tapping screws.

7. The door of claim 1, wherein the channel is configured such that when the threaded fasteners are inserted into the channel, the walls spread and apply lateral force to the threaded fastener.

8. The door of claim 1, wherein the first frame piece and the second frame piece each comprise metal sheet.

9. The door of claim 1, wherein the first frame piece and the second frame piece comprise roll formed steel.

10. The door of claim 1, wherein the first frame piece and the second frame piece each comprise four elongated members assembled into a rectangular shape.

11. A kit for mounting a frame in a partitioning structure, the kit comprising:

a first frame piece forming a perimeter defining a first opening;

a second frame piece forming a perimeter defining a second opening, the second frame piece comprising a web having a first end and a second end with a first leg extending in a first direction from the first end of the web to a first distal end and a second leg extending in the first direction from the second end of the web to a second distal end to place the first leg and the second leg in parallel alignment, the first distal end of the first leg having an end configured to abut a face of the partitioning structure, a flange extending from the second distal end of the second leg in a direction away from the first leg, and walls extending from the flange and defining an elongated channel, the channel disposed on one side of the flange and having an open end and a closed end, the channel walls configured such that the closed end of the channel is between the open end of the channel and the first leg, the channel walls defining a width adapted to receive a threaded fastener; and threaded fasteners, wherein the first frame piece and the second frame piece are configured to be mounted to each other when the threaded fasteners extend through the first frame piece and into the channel, without the first frame piece penetrating the opening between the walls of the channel.

12. The kit of claim 11, wherein the second frame piece is of one-piece, seamless, unitary construction.

13. The kit of claim 11, wherein the elongated channel is continuous around the second frame piece.

14. The kit of claim 11, wherein the channel is configured such that the threaded fasteners penetrate the bottom of the channel when the first frame piece and the second frame piece are mounted to each other.

15. The kit of claim 14, wherein the threaded fasteners are self-tapping screws.

16. The kit of claim 11, wherein the channel is configured such that when the threaded fasteners are inserted into the channel, the walls spread and apply lateral force to the threaded fastener.

17. The kit of claim 11, wherein the first frame piece and the second frame piece each comprise metal sheet.

18. The kit of claim 11, wherein the first frame piece and the second frame piece comprise roll formed steel.

19. The kit of claim 11, wherein the first frame piece and the second frame piece each comprise four elongated members assembled into a rectangular shape.

20. A partitioning structure including a framed opening, comprising:

a partitioning structure having two sides and defining an opening therethrough; and a frame in the structure opening, the frame comprising:

a first frame piece defining holes for threaded fasteners spaced along the first frame piece, the first frame piece forming a perimeter defining a first opening; and a second frame piece forming a perimeter defining a second opening, the second frame piece comprising a web having a first end and a second end with a first leg extending in a first direction from the first end of the web to a first distal end and a second leg extending in the first direction from the second end of the web to a second distal end to place the first leg and the second leg in parallel alignment, the first distal end of the first leg having an end configured to abut a face of the partitioning structure, a flange extending from the second distal end of the second leg in a direction away from the first leg, and walls extending from the flange and defining an elongated channel, the channel including a bottom with walls extending therefrom to form an opening, the channel disposed on one side of the flange and having an open end and a closed end, the channel walls configured such that the closed end of the channel is between the open end of the channel and the first leg, the channel walls defining a width adapted to receive a threaded fastener, and threaded fasteners, wherein the first frame piece and the second frame piece are mounted to each other from each side of the partitioning structure with the threaded fasteners and the frame is mounted to the partitioning structure, wherein the threaded fasteners extend through the holes in the first frame piece and into the channel without the first frame piece penetrating the opening defined by the walls of the channel.

21. The partitioning structure of claim 20, wherein the partitioning structure comprises a door.

22. The partitioning structure of claim 20, wherein the elongated channel is continuous around the second frame piece.

23. A method of assembling a door lite kit in a door, the door having two sides and defining a window opening therethrough, the door lite kit comprising:

a first frame piece defining holes for threaded fasteners spaced along the first frame piece, the first frame piece forming a perimeter defining a first opening; and a second frame piece forming a perimeter defining a second opening, the second frame piece comprising a web having a first end and a second end with a first leg extending in a first direction from the first end of the web to a first distal end and a second leg extending in the first direction from the second end of the web to a second distal end to place the first leg and the second leg in parallel alignment, the first distal end of the first leg having an end configured to abut a face of the partitioning structure, a flange extending from the second distal end of the second leg in a direction away from the first leg, and walls extending from the flange and defining an elongated channel, the channel including a bottom with walls extending therefrom to form an opening, the channel disposed on one side of the flange and having an open end and a closed end, the channel walls configured such that the closed end of the channel is between the open end of the channel and the first leg, the channel walls defining a width adapted to receive a threaded fastener, window glass, and threaded fasteners, the method comprising:

disposing the first frame piece and the second frame piece around the window opening;

extending threaded fasteners through the holes in the first frame piece and into the channel; and wherein the first frame piece is mounted to the second frame piece and the frame is mounted to the door, without the first frame piece penetrating the opening defined by the walls of the channel.

24. The method of claim 23, further comprising causing the threaded fasteners to penetrate the bottom of the channel to secure the first frame piece to the second frame piece.

25. The method of claim 23, wherein the elongated channel is continuous around the second frame piece.

* * * * *